US007661549B2

(12) United States Patent
Rae

(10) Patent No.: US 7,661,549 B2
(45) Date of Patent: Feb. 16, 2010

(54) MUTUALLY ENGAGABLE TWIN PERSONAL CARE BOTTLES

(76) Inventor: Pamela Rae, 3225 Donald Douglas Loop South, Santa Monica, CA (US) 90405

( * ) Notice: Subject to any disclaimer, the term of this patent is extended or adjusted under 35 U.S.C. 154(b) by 611 days.

(21) Appl. No.: 11/016,492

(22) Filed: Dec. 18, 2004

(65) Prior Publication Data

US 2005/0098558 A1 May 12, 2005

Related U.S. Application Data

(63) Continuation-in-part of application No. 29/191,218, filed on Sep. 30, 2003, now Pat. No. Des. 510,868.

(51) Int. Cl.
*B65D 21/02* (2006.01)
*A47G 19/00* (2006.01)

(52) U.S. Cl. ..... 220/23.4; 215/10

(58) Field of Classification Search ..... 220/23.4, 220/254.3, 254.1, 254.7; 206/504; 215/235, 215/237; 222/546
See application file for complete search history.

(56) References Cited

U.S. PATENT DOCUMENTS 3,933,268 A * 1/1976 Buske ..... 220/23.4
3,994,408 A * 11/1976 Belitzky ..... 215/10
4,457,458 A * 7/1984 Heinol ..... 222/498
4,573,595 A * 3/1986 Mednis ..... 215/10
5,199,618 A * 4/1993 Reil et al. ..... 222/541.5
5,339,993 A * 8/1994 Groya et al. ..... 220/254.3
5,456,380 A * 10/1995 Ito et al. ..... 220/713
5,485,920 A * 1/1996 Fritz ..... 206/509
6,772,898 B1 * 8/2004 Florino et al. ..... 220/23.4
7,011,227 B2 * 3/2006 Ward et al. ..... 220/254.3

FOREIGN PATENT DOCUMENTS

WO WO 01/40065 A1 * 6/2001

* cited by examiner

*Primary Examiner*—Anthony Stashick
*Assistant Examiner*—Harry A Grosso
(74) *Attorney, Agent, or Firm*—Gene Scott; Patent Law & Venture Group

(57) ABSTRACT

A pair of containers, provide complimentary outer surface contours so as to be mutually engagable in intimate nesting contact. Each of the containers provides an outwardly extending embossment and an inwardly extending groove. The embossment of each of containers is positioned and sized for frictional engagement with the groove on the other of the pair of containers for mutual securement of the containers when the containers are nested, thereby enabling the containers to be engaged and handled as a unit while dispensing different materials.

2 Claims, 4 Drawing Sheets

MUTUALLY ENGAGABLE TWIN PERSONAL CARE BOTTLES

RELATED APPLICATIONS

This application is a Continuation-In-Part application of a prior filed application having Ser. No. 29/191,218 and filing date of Sep. 30, 2003 now U.S. Pat. No. D510,868 and entitled: Personal Care Bottle.

BACKGROUND OF THE INVENTION

1. Incorporation by Reference

Applicant(s) hereby incorporate herein by reference, any and all U.S. patents and U.S. patent applications cited or referred to in this application.

2. Field of the Invention

This invention relates generally to personal care bottles such as used for containing and dispensing shampoo, mouthwash, and lotions; and more particularly to a pair of such bottles that are mutually engagable so as to provide the benefit of ensuring that the bottles will conveniently continue to be used jointly.

3. Description of Related Art

The following art defines the present state of this field:

Smith, et al, U.S. Pat. No. 4,416,374: A nest-or-stack, lidless, open-stacking container for handling and storage of bulk material such as food products features a seamless, one piece plastic construction with channels formed into the bottom to permit the use of a forklift truck for moving, lifting and stacking of the container, and with stacking surfaces for stacking filled containers and nesting stop surfaces for nesting empty containers.

Kreeger, U.S. Pat. No. 4,383,611: A three-level stack and nest container is provided with a row of outwardly projecting stacking feet along the lower edges of a pair of opposed end walls.

Three stacking foot receiving seats are formed at the inner side of each end wall at different elevations in vertical alignment with each stacking foot so that two containers may be stacked or nested with the upper container at a high, intermediate or low elevation relative to the lower container depending upon which set of seats of the lower container are engaged by the feet of the upper container. Each vertically aligned group of seats includes recesses in the inner side of the end wall extending downwardly at opposite sides of the uppermost of the three seats. One recess will guide a stacking foot to the intermediate seat, the other recess will guide a stacking foot to the lower of the three seats.

Stahl, et al, U.S. Pat. No. 4,211,327: A container adapted to either stack or nest with another similarly oriented container of identical construction. The container has a plurality of feet along each side adjacent the bottom. The container side walls each have a lower section and an upper section spaced outwardly from the lower section and joined thereto by a ledge providing nesting saddles directly above the feet. The container also has a plurality of stacking saddles along the upper edge of each side wall likewise postioned directly above the feet. There are inclined ridges in the upper and lower sections of each side wall which guide the container down to a nested position within a lower container of identical construction.

Carroll, et al, U.S. Pat. No. 4,189,052: A container adapted to stack upon the endwalls of an identically oriented identical container, to partially nest within the endwalls of a reversely oriented identical container, and to have improved ability to resist the outward flexing of the endwalls that tends to occur due to the weight resting upon a container which is partially nested in the inventive container.

Johnson, U.S. Pat. No. 3,934,724: A nest and stack container adapted to nest in, or stack on, a lower container of like construction, depending upon the orientation of the upper container with respect to said lower container. The walls of the container comprise bar members which extend between the bottom and an upper guide rail of the container. Said bar members are arranged such that the bar members of an upper container parallel the bar members of a lower container during nesting. Said guide rails on opposite ends or sides of the container make possible "blind stacking" or "blind nesting" of the containers, even at heights greater than the height of the person stacking or nesting the containers.

Our prior art search with abstracts described above teaches containers with nesting and stacking features. However, this prior art fails to teach nesting containers with snap-action dual container attachment features, and also fails to teach a cap that also functions as a stabilizing element when the container is placed inverted on a surface. The present invention fulfills these needs and provides further related advantages as described in the following summary.

SUMMARY OF THE INVENTION

The present invention teaches certain benefits in construction and use which give rise to the objectives described below.

In a best mode preferred embodiment of the present invention, a pair of containers, provide complimentary outer surface contours so as to be mutually engagable in intimate nesting contact. Each of the containers provides an outwardly extending embossment and an inwardly extending groove. The embossment of each of containers is positioned and sized for frictional engagement with the groove on the other of the pair of containers for mutual securement of the containers when the containers are nested, thereby enabling the containers to be engaged and handled as a unit while dispensing different materials.

A primary objective of one embodiment of the present invention is to provide an apparatus and method of use of such apparatus that yields advantages not taught by the prior art.

Another objective is to provide containers that are mutually attachable for convenience when the contents of the containers provides complimentary substances such as hair shampoo and hair conditioner.

A further objective is to provide a cap for the containers that also provides a stabilizing function when the containers are placed upright on a surface.

Other features and advantages of the embodiments of the present invention will become apparent from the following more detailed description, taken in conjunction with the accompanying drawings, which illustrate, by way of example, the principles of at least one of the possible embodiments of the invention.

BRIEF DESCRIPTION OF THE DRAWINGS

The accompanying drawings illustrate at least one of the best mode embodiments of the present invention. In such drawings.

DETAILED DESCRIPTION OF THE INVENTION

The above described drawing figures illustrate the present invention in at least one of its preferred, best mode embodiments, which is further defined in detail in the following description. Those having ordinary skill in the art may be able to make alterations and modifications in the present invention without departing from its spirit and scope. Therefore, it must be understood that the illustrated embodiments have been set forth only for the purposes of example and that they should not be taken as limiting the invention as defined in the following.

Figure 1:
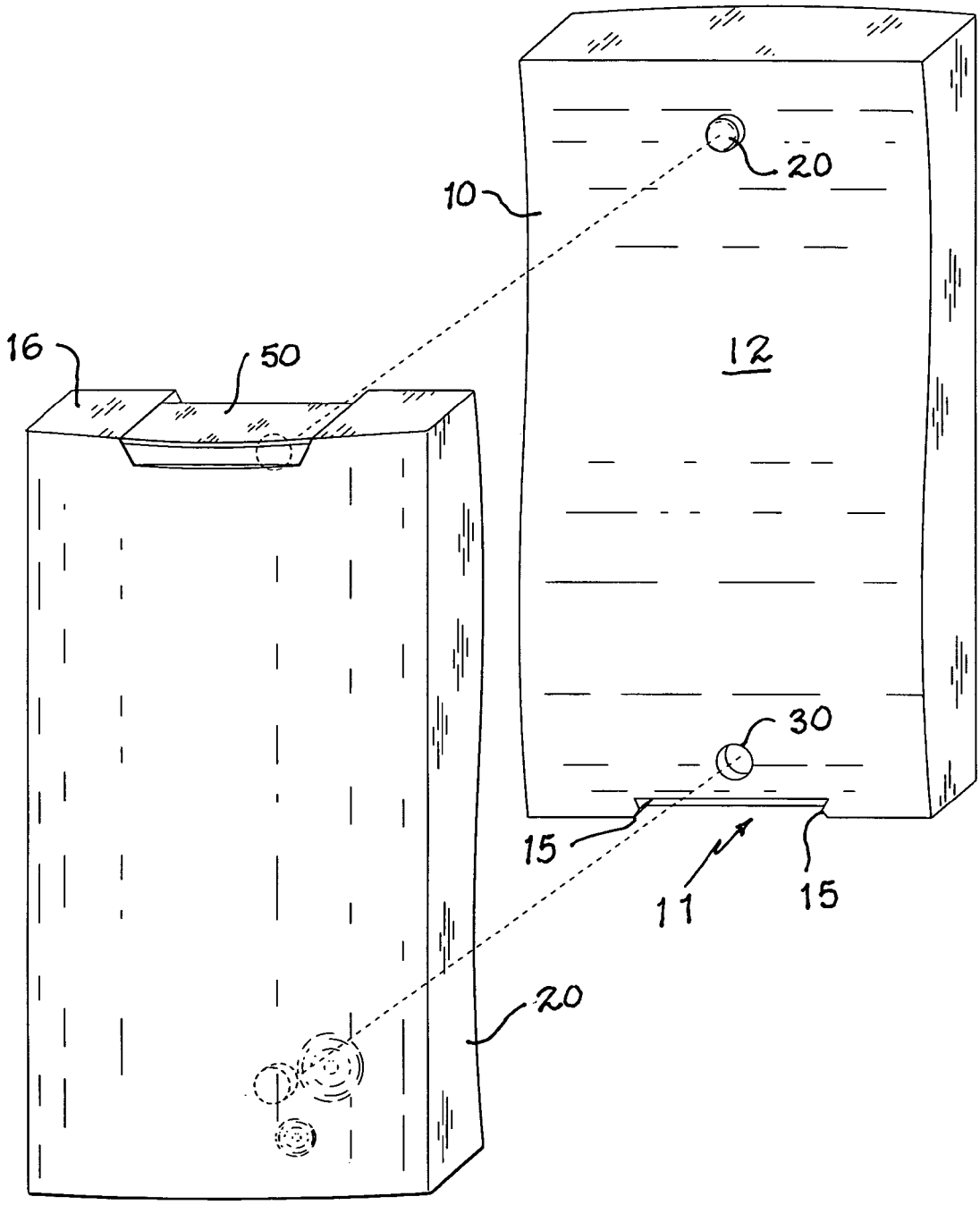
FIG. 1 is a perspective view of a preferred embodiment of the invention, showing containers mutually displaced.
Figure 2:
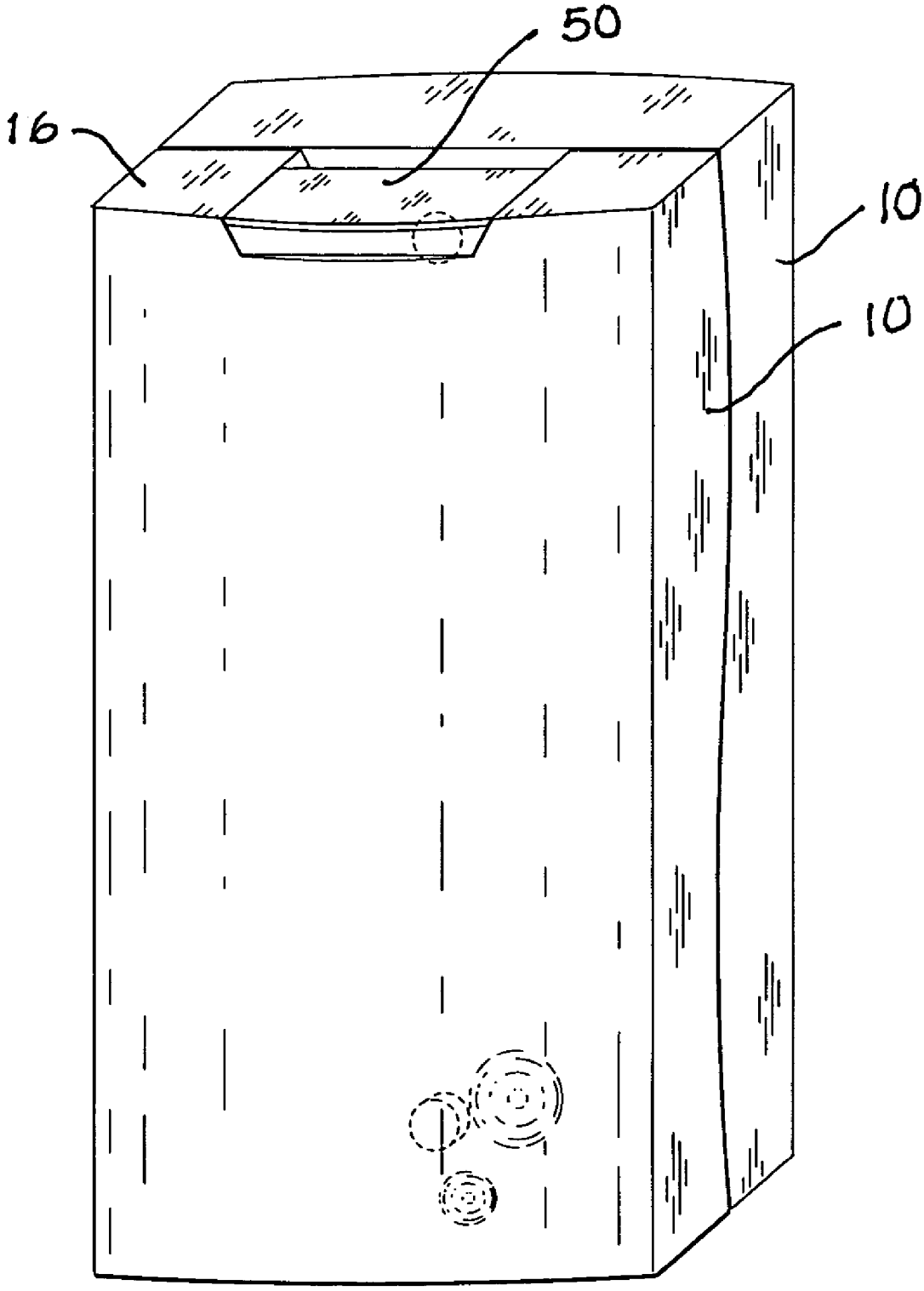
FIG. 2 is a perspective view thereof, showing the containers nested and joined, and with a cap of the invention shown in a closed attitude.
Figure 5:
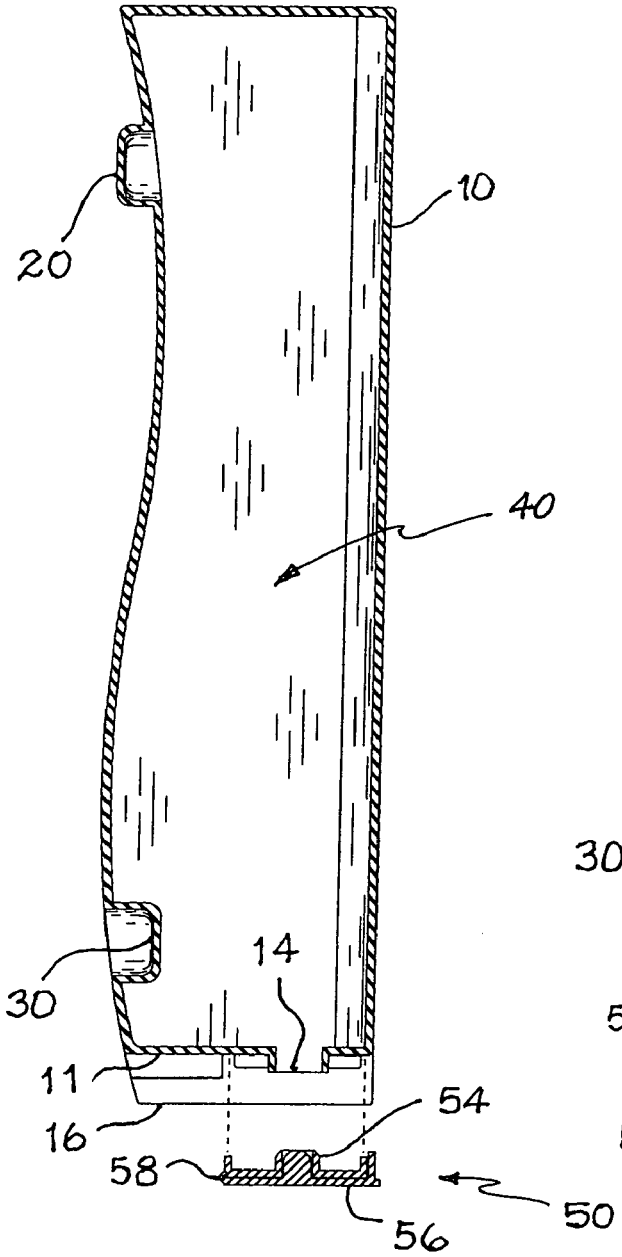
FIG. 5 is a vertical section through the container shown in FIG. 4 with the cap of the invention shown closed and removed from the container.
Figure 6:
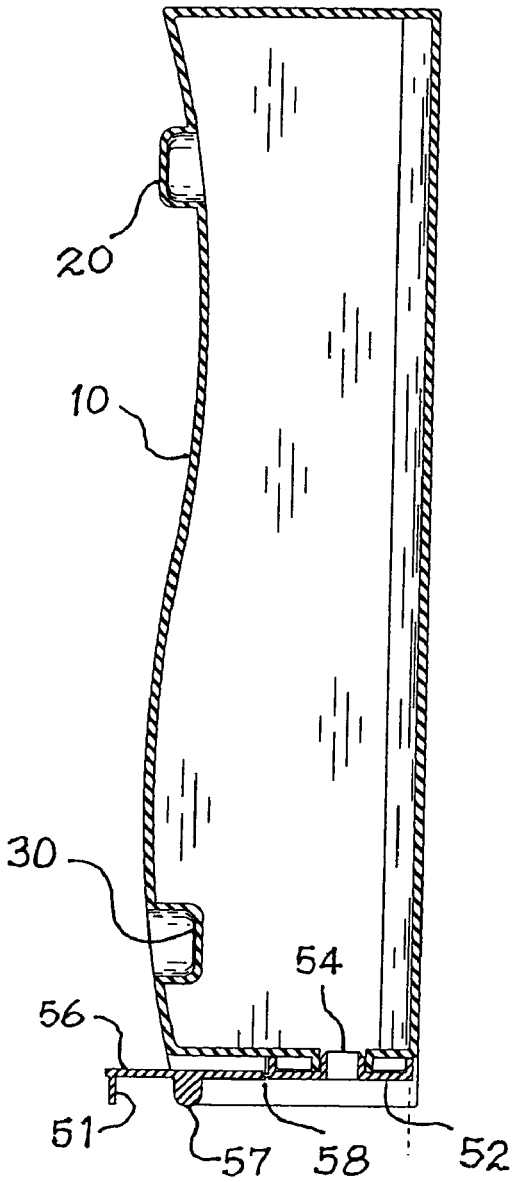
FIG. 6 is similar to FIG. 5 but showing the cap rotated into the open attitude and inserted into the container.

In one aspect of a best mode embodiment of the present invention apparatus a pair of identical containers 10, preferably are molded of a plastic material, and have an outer surface contour 12, so that the two containers 10 are mutually engagable in intimate nesting contact as shown in FIG. 2. The containers 10 provide at least one outwardly extending embossment 20, and at least one inwardly extending groove 30, as best seen in FIGS. 5 and 6. In the present embodiment the containers 10 have just one embossment 20 and one groove 30, but multiple embossments 20 and grooves 30 may be advantageous in some applications. The embossment 20 on each of the pair of containers 10 is positioned and sized for frictional engagement with the groove 30 on the other of the pair of containers 10 for mutual securement of the containers 10 when the containers are nested, as shown in FIG. 2, in this case by inverting one of the containers 10, and thereby enabling the containers to be joined and handled as a single unit. In the preferred embodiment both of the containers 10 are identical, as mentioned, but containers that are not strictly identical are considered to fall under the general understanding of the present disclosure. When identical containers 10 are used, only one set of molding dies need be fabricated to make both containers, so that the cost of manufacture may be less than if the containers are distinct.

Preferably, and of necessity, each of the containers 10 provides at least one aperture 14, in a top surface 16 of the container 10, the aperture 14 enabled for communication with an interior space 40 within the container 10. Preferably, the aperture 14 is stoppered by a plastic cap 50 for engaging the aperature 14. The cap 50 preferably provides a base portion 52 enabled with an outwardly extending hollow neck 54 functional for frictional engagement with the aperture 14 when inserted therein. The cap 50 further provides a cover portion 56 having an integral stopper portion 57, capable by its size and shape for stoppering the hollow neck 54 of the base portion 52. Preferably a hinge 58 is formed as a thin integral portion joining the base portion 52 and the cover portion 56, as shown in FIG. 5. This type of plastic hinge is often referred to as a "living hinge" and is fabricated as an integral part of the base and cover portions 52 and 56 respectively.

Figure 3:
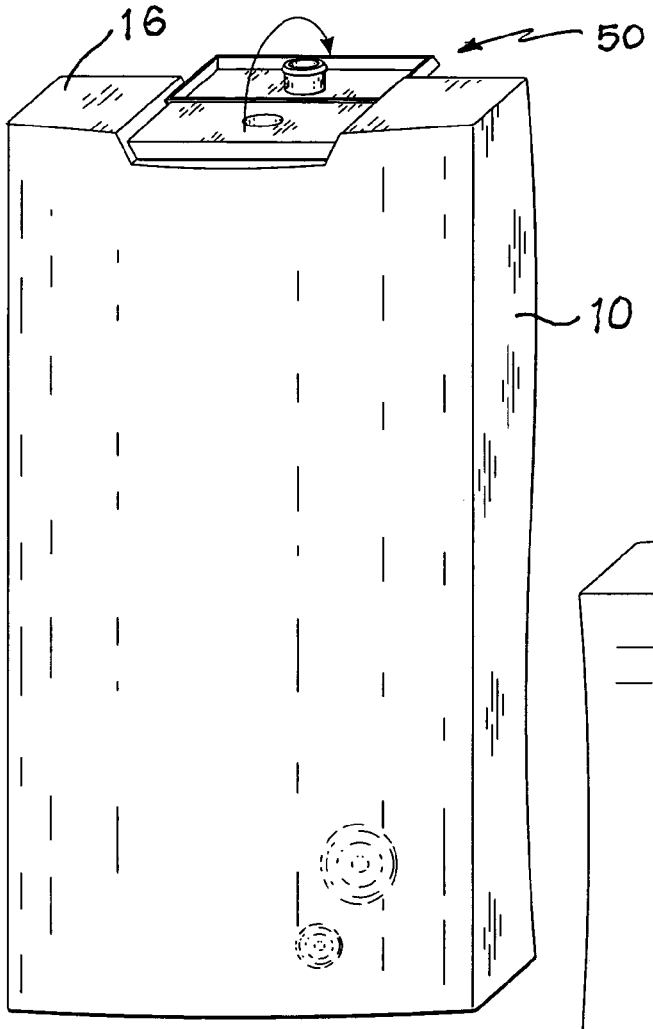
FIG. 3 is a perspective rear view thereof showing one container with the cap of the invention in the open attitude ready for dispensing.
Figure 4:
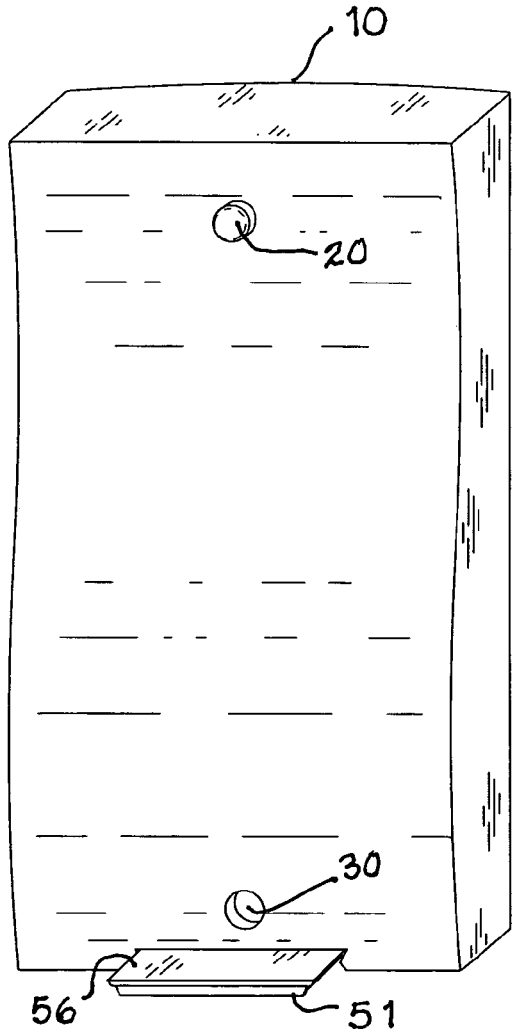
FIG. 4 is a perspective front view thereof showing one container as inverted and with the cap of the invention in the open attitude ready for supporting and stabilizing the container.

The cover portion 56 is therefore positionable for sealing the hollow neck 54 when in a closed attitude as shown in FIG. 5; and alternately positionable in an open attitude for stabilizing the container 10 when the container 10 is supported in an inverted orientation (on a surface for instance) as shown in FIG. 6. The cover portion 56 provides a flange 51 which is positioned on the cover portion 56, so that with the cover portion 56 in the open attitude, the flange 51 is in a position to contact the surface upon which the container 10 rests. The top surface 16 of the container 10 provides a slot 11, and the slot 11 has opposing slot lips 15 which are spaced apart so that with the cover portion 56 in the open attitude, it is captured by the lips 15, i.e., held by the lips 15 within the slot 11 and thus restrained in the preferred open attitude as shown in FIGS. 3 and 6.

Of course, when the container is filled with a lotion or such for dispensing, the cap 50 is used to seal the container 10 and for allowing the material to be dispensed through the hollow neck 54 when the cap 50 is rotated to remove the stopper portion 57 from the neck 54.

The enablements described in detail above are considered novel over the prior art of record and are considered critical to the operation of at least one aspect of one best mode embodiment of the instant invention and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or elements of the embodiments of the herein described invention and its related embodiments not described are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the invention and its various embodiments or that a single element may be substituted for two or more elements in a claim.

Changes from the claimed subject matter as viewed by a person with ordinary skill in the art, now known or later devised, are expressly contemplated as being equivalents within the scope of the invention and its various embodiments. Therefore, obvious substitutions now or later known to one with ordinary skill in the art are defined to be within the scope of the defined elements. The invention and its various embodiments are thus to be understood to include what is specifically illustrated and described above, what is conceptually equivalent, what can be obviously substituted, and also what essentially incorporates the essential idea of the invention.

While the invention has been described with reference to at least one preferred embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. An apparatus comprising:

a pair of containers having complimentary contours on external surfaces thereof such that with one of the containers inverted, with respect to the other one of the containers, said external surfaces are nestable;

each said external surface having an embossment distally positioned from a groove, so that with the embossment of each one of the containers frictionally engaged with the groove of the other one of the containers, the containers are thereby impermanently joined;

each of the containers having an aperture therein;

each of the containers engaged with a removable cap having a primarily planar base portion hinged, by a hinge, to a primarily planar cover portion wherein the base portion and the cover portion may assume a mutually coplanar attitude and alternately may assume a surface-to-surface contacting attitude, the base portion providing a hollow neck having a through hole therein, the hollow neck extending to one side or the base portion, the cover portion providing a stopper portion extending to one side of the cover portion and positionable into the through hole of the hollow neck when the cover portion is in the surface to surface contacting attitude relative to the base portion, the cover portion further providing a flange positioned in opposition to the hinge, the flange extending to one side of the cover portion and positionable in contact with an edge of the base portion, wherein with the hollow neck inserted within the aperture, the hollow neck is sealed by the stopper portion and the aperture is sealed by the hollow neck within the aperture, and wherein a pair of spaced apart lips on a top surface of the each container engages and secures the cover portion when in the mutually coplanar attitude.

2. The apparatus or claim 1 wherein the hinge is a living hinge.

* * * * *